United States Patent [19]

Sutch

[11] Patent Number: 4,465,205

[45] Date of Patent: Aug. 14, 1984

[54] FRAGILE OPENING MEANS FOR A CONTAINER LID

[76] Inventor: Brian L. C. Sutch, 49 The Island, Thames Ditton, Surrey, England

[21] Appl. No.: 552,853

[22] Filed: Nov. 17, 1983

Related U.S. Application Data

[63] Continuation-in-part of Ser. No. 440,175, Nov. 8, 1982, abandoned.

[30] Foreign Application Priority Data

Nov. 16, 1981 [GB] United Kingdom ..... 8134493

[51] Int. Cl.[3] ..... B65D 17/40

[52] U.S. Cl. ..... 220/276; 220/270; 220/306; 220/309

[58] Field of Search ..... 220/270, 276, 306, 309

[56] References Cited

U.S. PATENT DOCUMENTS 4,212,409 7/1980 Jeppsson ..... 220/276

4,376,493 3/1983 Gall ..... 220/309

4,387,820 6/1983 Ignell ..... 220/306

*Primary Examiner*—George T. Hall

*Attorney, Agent, or Firm*—Scrivener Clarke Scrivener and Johnson

[57] ABSTRACT

A tamper evident retainer to hold a closure and container in closed condition, the retainer having a displaceable extension flange carrying retaining means, in the initial condition of the retainer, before application of the closure to the container, the retainer having the extension flange and retaining means out of the path of relative movement of the closure and container during closing and being displaceable to position the retaining means in the path of relative movement of the closure and container during opening, the retainer having a weakened zone so that access can be had to the container by rupturing the weakened zone to release the retaining means and thereby allow the closure to be removed from the container.

10 Claims, 11 Drawing Figures

FRAGILE OPENING MEANS FOR A CONTAINER LID

This application is a continuation-in-part of application Ser. No. 440,175, filed Nov. 8, 1982, now abandoned.

This invention is concerned with improvements in and relating to retainers for closures and containers and in particular a retainer on a closure which will make locking engagement with a container and which closure is intended to be removable from the container only after detachment from the closure of a part of the retainer to release said locking engagement.

There have been a number of proposals for retaining closures on containers where an outward projection is provided adjacent the lip of the container, of which one is a closure having an inwardly directed projection, which upon application of the closure to the container, will slide over to engage behind the respective projection on the container, a portion of the closure incorporating the closure projection being coupled to the closure by a weakened zone of the closure which upon rupture renders the closure projection removable from the closure and thereby the closure removable from the container.

According to the present invention there is provided a retainer for retaining a closure and a container in closed condition, the retainer comprising a main flange which hingedly carries extension flange means which in turn carry retaining means, characterised in that the extension flange means and retaining means having a predetermined attitude relative to one another, the retainer, in an initial condition before the closure is applied to the container has the extension flange means and retaining means in a first position relative to the main flange where they are clear of the path of relative movement of the closure and container in application of the closure to the container, the extension flange means and retaining means, whilst remaining in their predetermined attitude relative to one another are displaceable; after application of the closure to the container, relative to the main flange, to position the retaining means in the path of a relative movement of the closure and the container in the direction of removal of the closure from the container, and a zone of weakening is provided in the retainer where a rupture can be effected to separate the extension flange from the container to allow separation of the closure and container.

The container or the closure may be a solid injection moulding or a composite article, that is to say an article which is at least in part a blank of card, board, foil or the like on which an injection moulding has been formed, in the case of a container to seam the blank and form a rim and in the case of a closure to create the rim. The container or closure may also be thermo-formed or vacuum formed.

The zone of weakening is preferably a region of reduced thickness relative to the remainder of the rim, or perforations or both.

In order that the invention may be well understood there will now be described some embodiments thereof, given by way of example only, reference being made to the accompanying drawings in which:

FIG. 1 is a section through a closure as made,

FIG. 2 is a section through the closure of FIG. 1 after application to a container, FIG. 3 is a section through part of a tool for applying a closure, FIG. 4 is a sectioned scrap perspective view of a second embodiment of closure, FIG. 5 is a sectioned scrap perspective view of a third embodiment of closure, FIG. 6 is a scrap sectioned perspective view of the embodiment of FIG. 5 but with a modified pull tab, FIG. 7 is a scrap sectioned perspective view of the mouth of a container.

Figure 1:
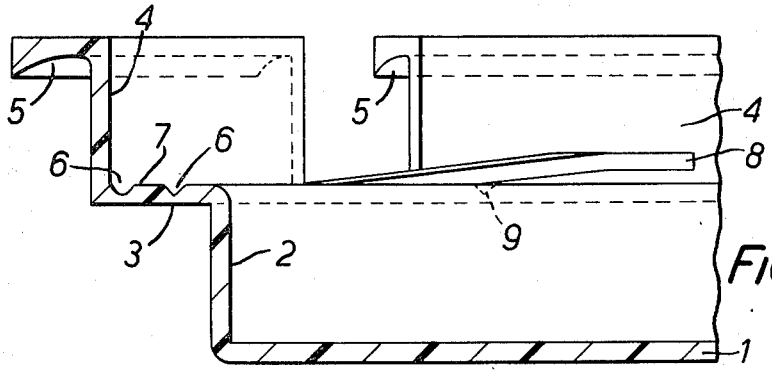

Referring to FIG. 1 a circular closure is shown which comprises a central region 1 having an upstanding wall 2, the closure having a retainer, here formed integrally with it and having a main flange 3 and extension flange means 4 having closure retaining means 5. The closure and retainer are here shown as a one piece injection moulding but the central region could be a blank of card or the like as already described.

The extension flange means may be continuous around the closure or interrupted (as shown) and the retaining means are also preferably spaced apart.

In the initial condition of the moulding the extension flange means are in an attitude where they themselves are, and they hold the retaining means, clear of the path of relative movement of the closure and container as the two are brought to the closed condition.

In the flange 3 are two regions of weakening 6 formed by the moulding being of reduced thickness along two parallel paths, the region therebetween forming a tear band 7 which, in known fashion, is provided with a pull tab 8 which, on being pulled, will initiate rupture of the flange at a transverse line of weakening 9 and along the regions 6 to release the extension flange from the container.

Figure 2:
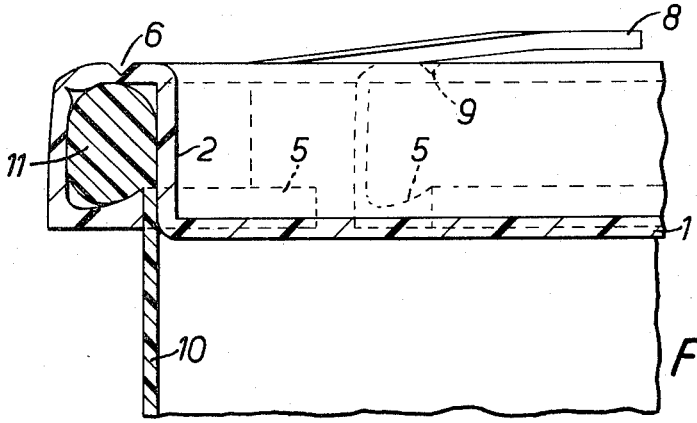
Figure 3:
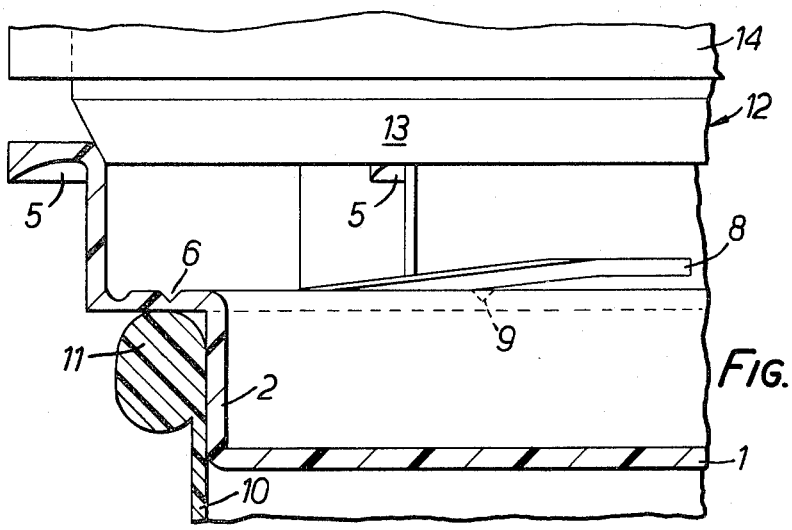

To apply such a closure to a cylindrical container 10 (FIG. 2), having a retaining projection or bead 11, the closure is placed over the container which itself is located below a closure tool 12 (FIG. 3). The tool includes a punch 13 and a sleeve 14. The punch and sleeve descend, the former to drive the closure into the container mouth and to initiate outward displacement of the extension flange means 4 and thereafter the sleeve moves down independently of the punch to complete the displacement of the extension flange means relative to the main flange until those flange means achieve the attitude shown in FIG. 2 where the retaining means 5, while maintaining the same attitude relative to the extension flange means have reversed to now lie behind the bead 11, that is to say in the path of relative movement of the closure and container in the opening direction. This displacement of the extension flange means is achieved against the resistance of the material of the moulding and is completed with an element of snap action. When displacement has been completed, unauthorised access by return of the moulding to the initial condition by hand is difficult without it being evident that an attempt has been made to gain access to the interior of the container.

To remove the closure, upward pull on the tab 8 will withdraw the tear band thereby detaching the extension flange means and retaining means from the closure and allowing the closure to be removed.

In FIG. 3, the retaining means 5 are contoured to merge into the initially inner surface of the extension flange means 4 thereby making illegitimate removal more difficult by denying a purchase on the squared off junction between the retaining means and the extension flange means of FIGS. 1 and 2.

Figure 4:
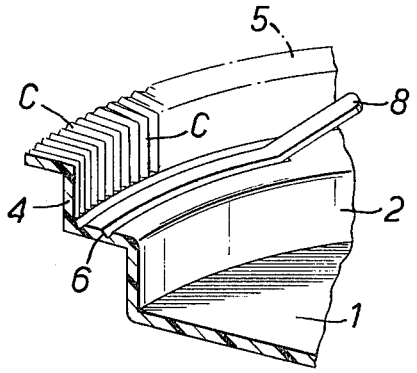

In an alternative arrangement, the extension flange means, where continuous or interrupted, may be corrugated to allow for the increase in length required to accommodate the displacement of the extension flange means from the initial condition before application of the closure to the retaining condition. The closure retaining means may also be corrugated for the same reason. Such an arrangement is shown in FIG. 4 where the same reference numerals have been used for parts corresponding to the embodiment of FIGS. 1 and 2, the corrugations being indicated at C, and the extension flange means and retaining means being shown as continuous.

With the embodiments described, even if a party succeeds in easing the closure off a container, the closure is not readily replaceable to hide the fact that it has been removed unlawfully. It will require displacement of the flange means and retaining means to their initial relative attitudes, re-application of the closure and re-displacement of the flange means and retaining means, all without damaging the joint between the closure and the retaining means.

Figure 5:
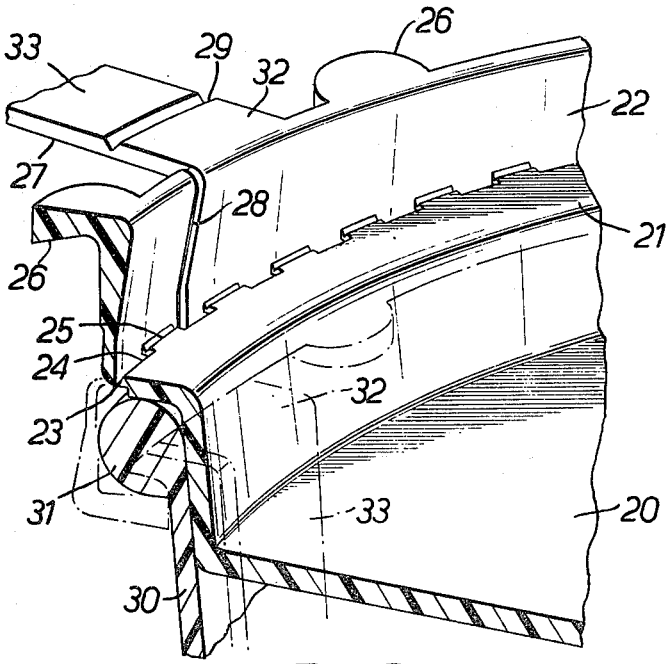

Referring now to FIG. 5 a closure is shown comprising a central region 20 having a main flange 21, a continuous extension flange 22 coupled to it through a zone 23 weakened by alternate perforations 24 and connections 25 themselves of reduced thickness, retainers 26 being carried by and spaced along the extension flange. A tab 27 is coupled to the extension flange adjacent a starting weakened zone 28 and itself has a weakened zone 29.

On application of this closure to container 30, the extension flange is displaced to the position shown in broken line where the retainers 26 engage behind bead 31 and the tab part 32 of tab 27 will take the same attitude and act as a retainer 26, while tab part 33 of tab 27 will lie against the outer face of the container by virtue of zone 29 acting as a hinge. To remove the closure tab 27 is pulled which will rupture zone 28 and thereafter zone 23 and thereby remove the retainers 26 and extension flange 22 progressively clockwise round the main flange and allow removal of the closure. The extension flange is progressively thickened towards the junction between it and the retainers 26 to encourage it to snap into and remain in the displaced retaining condition.

Figure 6:
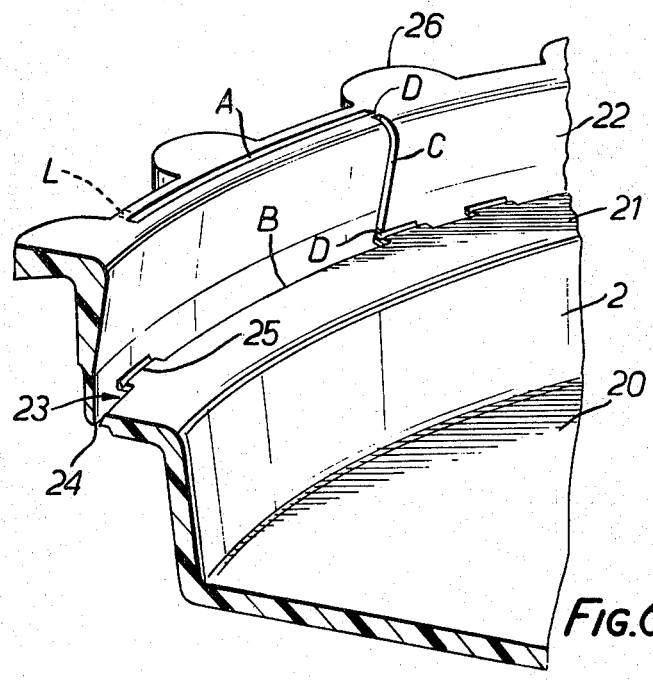

Referring now to FIG. 6, there is shown a closure as in FIG. 5, with the same references indicating like parts, but with no pull tab 27 or weakening 28, the arrangement of the extension flange 22 and retainers 26 being undisturbed by the presence of a pull tab. Instead a tongue is created by forming an elongate aperture A adjacent the root of the retainers, a similar aperture B in the root of the extension flange and a third aperture C in the extension flange extending between the ends of apertures A and B but spaced from each of them by bridges D. With such an arrangement, when the extension flange is urged from its initial position to the retaining position, the bridges D will snap to create a tongue which can be used to break the zone 23. If desired a line of weakening L may be provided across the root of the retainers.

Figure 7:
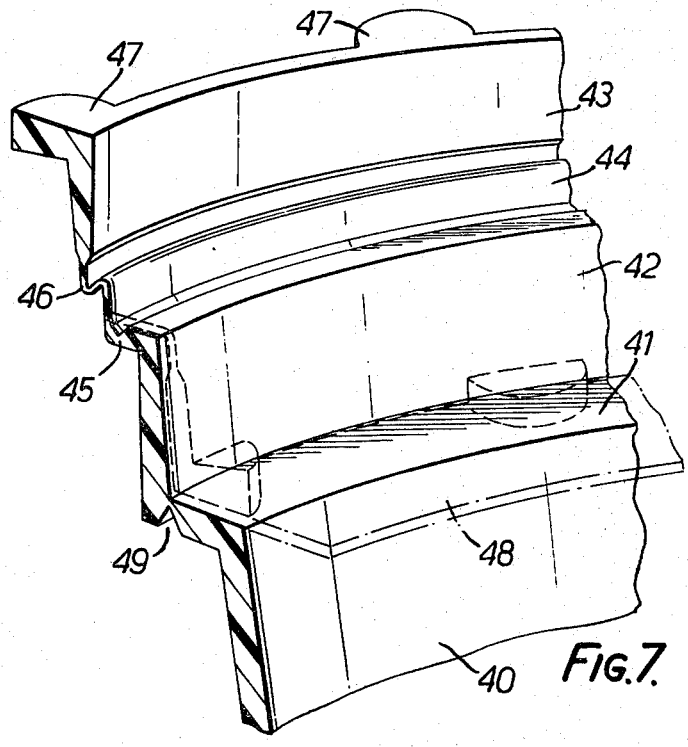

Referring to FIG. 7 there is shown a container 40 having a moulded radial wall or step 41. Integral with the wall is a retainer including a main flange 42, from which in turn extends an extension flange 43 through a secondary extension 44 which is coupled to the main flange and extension flange by hinge pieces 45, 46. On the extension flange are retainers 47.

In the initial condition of the moulding the extension flange once again holds itself and the retaining means out of the path of relative movement of a closure 48 shown in chain dot line and the container 40 as the closure is moved on to the step 41 in the closing direction.

After the closure 48 has been placed on step 41, the secondary extension flange 44 and the extension flange 43 are displaced to a position respectively overlying and within the main flange with the retainers 47 bearing down on the closure, this situation being shown in broken lines.

In this condition, the retaining means lie in the path of relative movement of the closure and container in the opening direction.

The hinge pieces 45, 46 are formed by reduced regions and hinge part 45 may constitute the weakened zone which can be ruptured to allow removal of the extension flange and retainers or this zone may be formed at 49, appropriate pull tabs being provided but not shown here.

As in the case of the embodiments of FIGS. 1 to 5, the container may be formed in any suitable fashion, that is as a composite or as a solid injection moulding or in any other fashion which will allow provision of the retainer described. The mouth can be a moulding for application to a container as a separately made item.

All of the arrangements described are aimed at security of the contents of a container and at providing a tamper evident arrangement to warn that the contents may have been interferred with.

Figure 8:
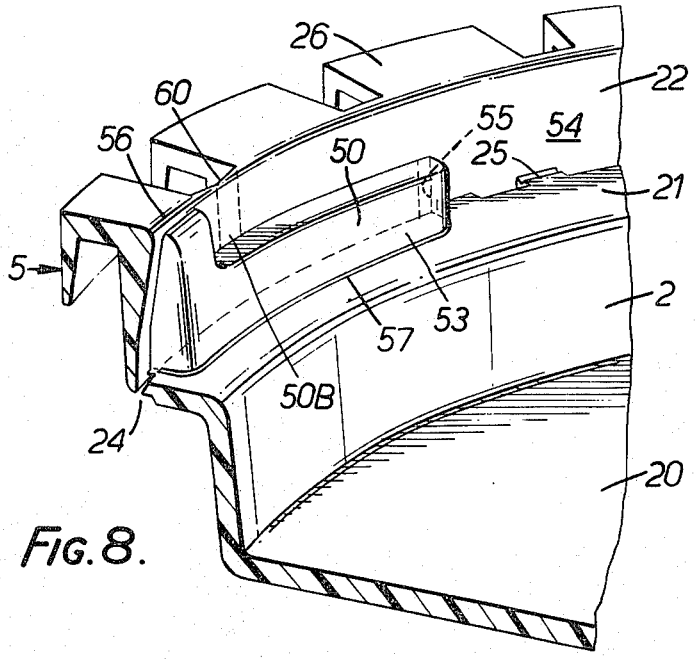
FIG. 8 is a view similar to FIG. 6 but having a modified tongue.
Figure 9:
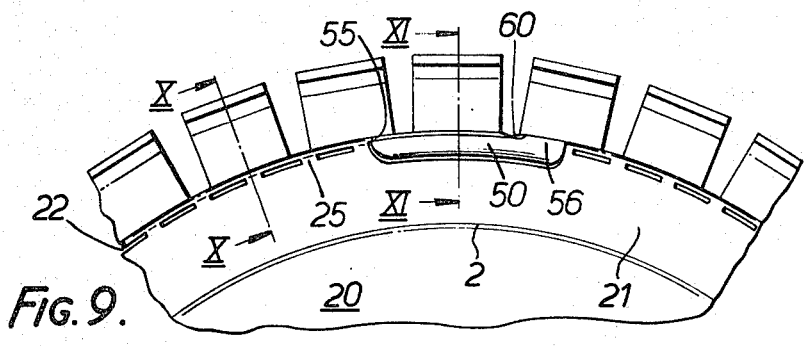
FIG. 9 is an underneath view of the tongue of FIG. 8.
Figure 10:
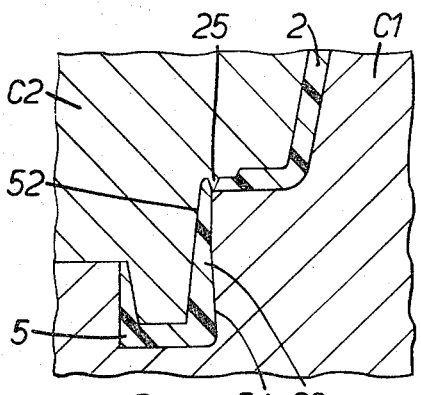
FIGS. 10 and 11 are sections on the lines x—x and x1—x1 of FIG. 9.
Figure 11:
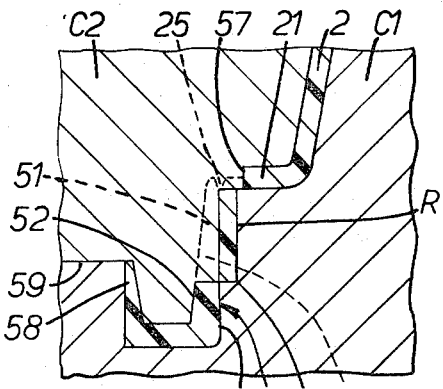

Referring now to FIGS. 8 to 11, a tongue 50 is created on extension flange 22 by providing a radial inward projection 50A on cavity tool C2 to thereby create an indentation 51 on the external surface 52 of the extension flange while a recess R is provided on the external surface of the core tool C1 to create a projection 53 on the internal surface 54 of the extension flange 22. One circumferential end of the indentation 51 and the associated circumferential end of the projection 53 is created by a shut-off formed by the tools, resulting in interruption 55 in the moulding extending axially of the lid, and creating a line of weakness in the moulding. The other end of the indentation 51 on surface 52 is offset circumferentially, relative to the associated end of the projection 53 so that the tongue 50 is connected flexibly to the extension flange 22 at 56. The depth, axially of the lid, of the tongue is less than the axial depth of the extension flange 22, the upper edge 50B of the tongue as viewed in FIG. 8 being below the junction of the extension flange 22 and retainers 26 while the lower inner edge of the tongue is above or in the plane of the upper surface of the main flange 21 so that that lower inner edge of the tongue as viewed in FIG. 8 is spaced from the upper outer edge of an edge recess 57 in the main flange produced by a part of the radially inwardly extending projection 51 on the cavity tool which part of the projection additionally interrupts the series of connections 25 provided between the main flange and extension flange. Another part of the projection provides a weakening 60 in that part of the extension flange above and adjacent to the connection 56 of the tongue to the extension flange to allow the tongue to break the continuity of the moulding part carrying the retainers 26. There is thus provided the series of spaced connections 25 and a pull tongue 50 which is pivotally anchored at one end to the extension flange, and will be outwardly accessible on the external surface of the extension flange, when the lid has been applied and turned over the edge of the container, whereby the extension flange can be pulled away from the main flange and container and thereby allow the lid to be removed. The lid will still be in a condition to be re-applied to the container with the main flange still attached and serving to rest upon the lip of the container. If an undercut is required on the parts 58, the core and cavity tools should part on the line 59. No blades or moving parts, particularly susceptible to wear and breakage and adding to cost in tool production, are required in either the core or cavity tool to create the pull tongue.

I claim:

1. A retainer for retaining a closure and a container in closed condition, the retainer comprising a main flange which hingedly carries extension flange means which in turn carry retaining means, said extension flange means and retaining means having a predetermined attitude relative to one another, the retainer, in an initial condition before the closure is applied to the container, having the extension flange means and retaining means in a first position relative to the main flange where they are clear of the path of relative movement of the closure and container in application of the closure to the container, the extension flange means and retaining means, whilst remaining in their predetermined attitude relative to one another, being displaceable after application of the closure to the container, relative to the main flange to position the retaining means in the path of the relative movement of the closure and the container in a direction of removal of the closure from the container, and a zone of weakening in the retainer where a rupture can be effected to separate the extension flange from the container to allow separation of the closure and container.

2. A retainer according to claim 1 in which the retainer is a peripheral part of the closure which has a central region and an upstanding peripheral wall, the main flange being integral with that wall, projecting outwardly therefrom relative to the central region and carrying the extension flange means initially projecting in the same direction as the wall projects from the central region, and the retaining means projecting outwardly from the extension flange means in the same direction as the main flange extends from the wall, displacement of the extension flange means from the initial condition after application of the closure to a container, positioning the retaining means around the container in an inwardly projecting attitude relative to the container, to provide a means to engage behind outwardly projecting means on the container thereby to hold the closure on the container.

3. A retainer according to claim 2 in which there is a weakened zone in the main flange to effect rupture of the retainer to separate the retaining means from the central region.

4. A retainer according to claim 2 in which a weakened zone is provided between the extension flange means and main flange to afford detachment of the retaining means from the central region.

5. A retainer according to any of claims 2 to 4 in which spaced circumferentially extending apertures are provided in the extension flange means and a transverse aperture each end of which is spaced from one of the spaced apertures at a position adjacent the end of that spaced aperture by a bridge which will rupture on displacement of the extension flange means from the initial position to the retaining position to provide a pull tab for use in removing the retaining means from the central region.

6. A retainer according to claim 1 in the form of a lip for an open top container, the retainer main flange extending (in use of the container) upwards, relative to the container, from a container wall forming an outwardly extending step within the container, a secondary extension flange connecting the main flange with the extension flange means which extend upwardly relative to the main flange and retaining means on the extension flange means and projecting outwardly therefrom, in the same direction as the step, relative to the container, the extension flange means being displaceable, after positioning of a closure on the step, to lie within the main flange, and to position the retaining means on the closure and projecting inwardly over the closure to retain the closure on the step.

7. A retainer according to claim 2 in which is provided a pull tongue defined by a recess in that face of the extension flange directed away from the main flange and a projection on the extension flange means on the other face of that flange means, one end of the recess lying adjacent one end of the projection to offset that tongue end relative to the extension flange means and provide a weak connection between the tongue and the extension flange means, the other end of the recess being spaced from the corresponding end of the projection to provide an anchorage of the tongue to the extension flange means, the recess in the external surface of the extension flange means extending from a recess in the main flange which corresponds to the projection on the extension flange means to offset the edge of the tongue nearest the main flange relative to that flange, the tongue being displaceable relative to the extension flange and main flange to initiate rupture of the zone of weakening.

8. A retainer according to claim 7 in which the recess in the extension flange means is within those flange means, the edge of the tongue remote from the main flange being offset relative to the part of the extension flange means lying to that side of the tongue remote from the main flange.

9. A moulding including a main flange, extension flange means extending from the main flange and coupled thereto by a zone of weakening, a pull tongue being defined by a recess in that face of the extension flange directed away from the main flange and a projection on the extension flange means on the other face of that flange means, one end of the recess lying adjacent one end of the projection to offset that tongue end relative to the extension flange means and provide a weak connection between the tongue and the extension flange means, the other end of the recess being spaced from the corresponding end of the projection to provide an anchorage of the tongue to the extension flange means, the recess in the external surface of the extension flange means extending from a recess in the main flange which corresponds to the projection on the extension flange means to offset the edge of the tongue nearest the main flange relative to that flange, the tongue being displaceable relative to the extension flange and main flange to initiate rupture of the zone of weakening.

10. A moulding as claimed in claim 9 in which the recess in the extension flange means is within those flange means, the edge of the tongue remote from the main flange being offset relative to the part of the extension flange means lying to that side of the tongue remote from the main flange.

* * * * *